US007003119B1

(12) United States Patent
Arthur

(10) Patent No.: US 7,003,119 B1
(45) Date of Patent: Feb. 21, 2006

(54) MATRIX SURROUND DECODER/VIRTUALIZER

(75) Inventor: John Eric Arthur, Calgary (CA)

(73) Assignee: Qsound Labs, Inc., Calgary Providence Alberta (CA)

( * ) Notice: Subject to any disclaimer, the term of this patent is extended or adjusted under 35 U.S.C. 154(b) by 0 days.

(21) Appl. No.: 09/282,848

(22) Filed: Mar. 31, 1999

Related U.S. Application Data

(63) Continuation-in-part of application No. 09/058,047, filed on Apr. 9, 1998, now Pat. No. 6,198,826, which is a continuation-in-part of application No. 08/858,586, filed on May 19, 1997, now Pat. No. 6,236,730.

(51) Int. Cl.
*H04R 5/00* (2006.01)

(52) U.S. Cl. ..... 381/17; 381/18; 381/20; 381/27

(58) Field of Classification Search ..... 381/17, 381/27, 18, 19, 20
See application file for complete search history.

(56) References Cited

U.S. PATENT DOCUMENTS

| | | | | |
|---|---|---|---|---|
| 5,105,462 A | | 4/1992 | Lowe et al. | 381/17 |
| 5,208,860 A | | 5/1993 | Lowe et al. | 381/17 |
| 5,440,638 A | | 8/1995 | Lowe et al. | 381/17 |
| 5,579,396 A | * | 11/1996 | Iida et al. | 381/18 |
| 5,774,556 A | | 6/1998 | Lowe et al. | 381/17 |
| 5,796,844 A | * | 8/1998 | Griesinger | 381/18 |

FOREIGN PATENT DOCUMENTS

| | | |
|---|---|---|
| EP | 0699012 A2 | 2/1996 |
| EP | 0865227 A1 | 9/1998 |
| EP | 0880301 A2 | 11/1998 |
| JP | 13002 | 2/1975 |
| JP | 116202 | 9/1977 |
| JP | 42495 | 4/1981 |
| JP | 70100 | 4/1984 |
| JP | 9212 | 1/1985 |

OTHER PUBLICATIONS

PCT Search Report (PCT/IB00/00788) dated Jan. 28, 2000.

* cited by examiner

*Primary Examiner*—Vivian Chin
*Assistant Examiner*—Justin Michalski
(74) *Attorney, Agent, or Firm*—Fulbright&Jaworski LLP

(57) ABSTRACT

The inventive mechanism uses several sub-systems to generate outputs from the stereo input signal. A first sub-system synthesizes the phantom center output, which places the monaural center image between the left and right speakers in front of the listener. A second sub-system synthesizes the virtual surround (or rear) output signals, which places the sound images to the sides of the listener. A third sub-system synthesizes the left and right stereo outputs, and expands the locations of the left and right sound images.

9 Claims, 2 Drawing Sheets

MATRIX SURROUND DECODER/VIRTUALIZER

RELATED APPLICATIONS

The present application is a continuation-in-part of and commonly assigned U.S. application Ser. No. 09/058,047 now U.S. Pat. No. 6,198,826, entitled QSOUND SURROUND SYNTHESIS FROM STEREO filed Apr. 9, 1998, which is incorporated herein by reference, which is a continuation-in-part of and commonly assigned U.S. application Ser. No. 08/858,586 now U.S. Pat. No. 6,126,730, entitled FULL SOUND ENHANCEMENT USING MULTI-INPUT SOUND SIGNALS filed May 19, 1997, which is incorporated herein by reference. The present application is related to co-pending and commonly assigned U.S. application Ser. No. 08/858,594, entitled METHOD AND SYSTEM FOR SOUND EXPANSION, filed May 19, 1997, which is incorporated herein by reference. The present application is related to commonly assigned U.S. Pat. No. 5,105,462, issued to Lowe, et al, entitled SOUND IMAGING METHOD AND APPARATUS, filed May 2, 1991, and issued Apr. 14, 1992, the disclosure of which is incorporated herein by reference. The present application is also related to commonly assigned U.S. Pat. No. 5,208,860, issued to Lowe, et al, entitled SOUND IMAGING METHOD AND APPARATUS, filed Oct. 31, 1991, and issued May 4, 1993, the disclosure of which is incorporated herein by reference. The present application is also related to commonly assigned U.S. Pat. No. 5,440,638, issued to Lowe, et al, entitled STEREO ENHANCEMENT SYSTEM, filed Sep. 3, 1993, and issued Aug. 8, 1995, the disclosure of which is incorporated herein by reference.

TECHNICAL FIELD OF THE INVENTION

This application relates in general to audio signal processing, and in particular to a decoding mechanism which synthesizes virtual surround channels from input signals having surround information encoded along with left, right and center audio signals.

BACKGROUND OF THE INVENTION

A recent trend in the audio industry is the use of matrix surround encoded stereo, for example Dolby Surround encoding, in audio signals. These audio signals may accompany analog or digital video signals, which together form a television signal, VCR signal, or CD or DVD signal. In Dolby systems, the encoder combines four different signals, i.e. left, right, center, and surround and produces two output signals, i.e. left total and right total. A further discussion of Dolby encoding, Surround decoders, and Pro Logic decoders may be found in "Dolby Pro Logic Surround Decoder Principles or Operation" by Roger Dressler, which is hereby incorporated by reference. The main difference between matrix surround decoders, for example a Dolby Pro Logic decoder and other decoders, is the way steering and relative balance between output channels is achieved.

The Surround decoder receives the two output signals, left total and right total, from the encoders and produces three output signals, i.e. left, right, and surround. The common or mono information contained in the left and right channels of a matrix surround encoded recording carries the center channel information, and thus the center signal is reproduced as a phantom image between the left and right speakers. The Surround decoder is typically a passive decoder as it uses (L−R) difference amplifier. The Pro Logic decoder receives the two output signals, left total and right total from the encoder, and produces four output signals, i.e. left, right, center, and surround. However, the Pro Logic decoder uses an adaptive matrix to continuously monitor the encoded audio signals, evaluate the inherent sound field dominance, and apply processing in the same direction and proportion to that dominance.

A problem with existing systems is that a listener has to use more than two speakers to get the desired surround effect from a sound source. This not only costs more in terms of the number of speakers to be purchased to get the desired sound effect, but also requires a room of adequate size so that the different speakers producing the left, right, center and surround sound may be placed at sufficient distances from the listener and also from each other to produce the desired sound effects. Thus, listeners with limited resources are not able to afford the multiple speaker systems or are unable to find means for placing the speakers to achieve the desired sound effects.

Another problem occurs when Dolby encoded audio materials are decoded on QSound systems. QSound systems use "Q-filters" in the processing of audio signals. The Q-filters could be part of a "QXpander circuit," wherein QXpander is a registered trademark of QSound. Also, the term "QXpander circuit" is a descriptive term used for the purpose of this application to refer to the filters more specifically described in U.S. Pat. No. 5,440,638 to Lowe et al., which is hereby incorporated by reference. The Q-filters could be Q1 filters. The term "Q1 filter" is also a descriptive term used for the purpose of this application to refer to the filters more specifically described in U.S. Pat. Nos. 5,105,462 and 5,208,860 both to Lowe et al., wherein each of these patents are hereby incorporated by reference. A Q-filter adjusts the amplitude and phase of an input signal on a frequency dependent basis. Note that the Q-filters use phase inverted signals during processing to achieve the QSound virtual audio image effects. Consequently, if an input signal to a Q-filter is already inverted from Dolby encoding, then the Q-filter system will re-invert the input signal and then proceed with processing of an improper, re-inverted signal. A re-inverted or non-inverted signal will adversely affect the expansion mechanisms of the Q-filter. Thus, the output signal will result in the incorrect placement of sound images. In other words, the surround images would appear to be located at the left and right speakers, and not placed to the sides or rear of the listener. Note that these effects would occur on other expansion mechanisms that use phase inversion.

Therefore, there is a need in the art for a mechanism which will correctly apply expansion mechanisms to both non-inverted signals and inverted signals.

SUMMARY OF THE INVENTION

These and other objects, features and technical advantages are achieved by a system and method which correctly operate on both non-inverted signals and inverted signals.

The inventive mechanism uses several sub-systems to generate outputs from the stereo input signal. In the preferred embodiment, a first sub-system synthesizes the phantom center output, which places the monaural center image between the left and right speakers in front of the listener. A second sub-system synthesizes the virtual surround (or rear) output signals via Q-filters, a delay device, an attenuator, and summers, and places the sound image to the sides of the listener. A third sub-system synthesizes the left and right stereo outputs, and via a QXpander circuit expands the locations of the left and right sound images. The QXpander circuit includes a Q-filter and summers. Thus, the inventive mechanism operates on center, surround, and stereo information contained in a matrix encoded stereo input signal, and processes each type of information differently to achieve the proper placement of the different sound images resulting from the different information.

A technical advantage of the present invention is to separately operate on center, surround, and stereo information contained within a matrix encoded stereo input signal.

Another technical advantage of the present invention is that center information contained within the stereo input signal is retained during processing of the input signal.

A further technical advantage of the present invention is that matrix encoded surround information contained within the stereo input signal is properly decoded and processed using Q-filters to create left and right surround sound images.

A further technical advantage of the present invention is that stereo information contained within the matrix encoded stereo input signal is operated on by a QXpander circuit which expands the sound images of the left and right stereo information.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
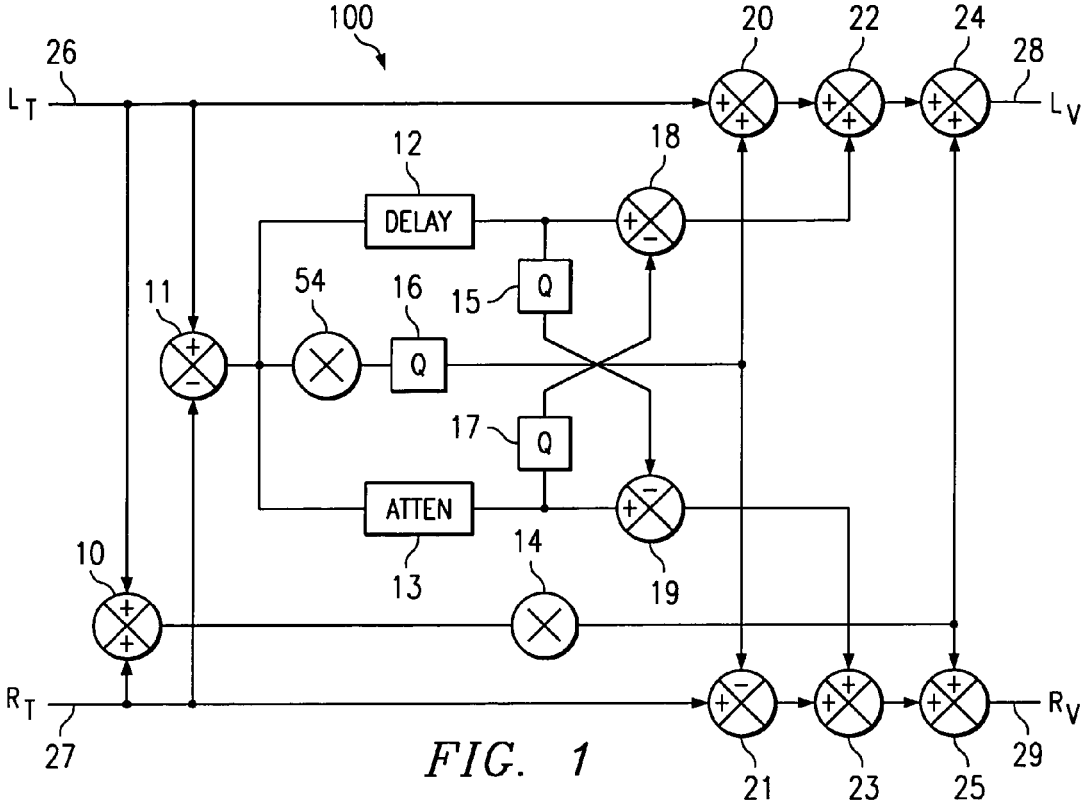
FIG. 1 is a schematic representation of the preferred embodiment of the inventive mechanism.

FIG. 1 depicts a preferred embodiment of the inventive mechanism. In the inventive arrangement 100 of FIG. 1, a two-channel stereo input from an A/V source, which includes encoded surround information, is converted into output signals. Left input 26 and right input 27 include four different signal portions-left, right, center, and surround. The input signals are processed into left output 28 and right output 29. Although only two outputs are shown, other outputs can be provided for rear or surround channels, a center channel, and/or a sub-woofer channel. The inventive arrangement 100 of FIG. 1 is subdivided into three subsystems.

Figure 2:
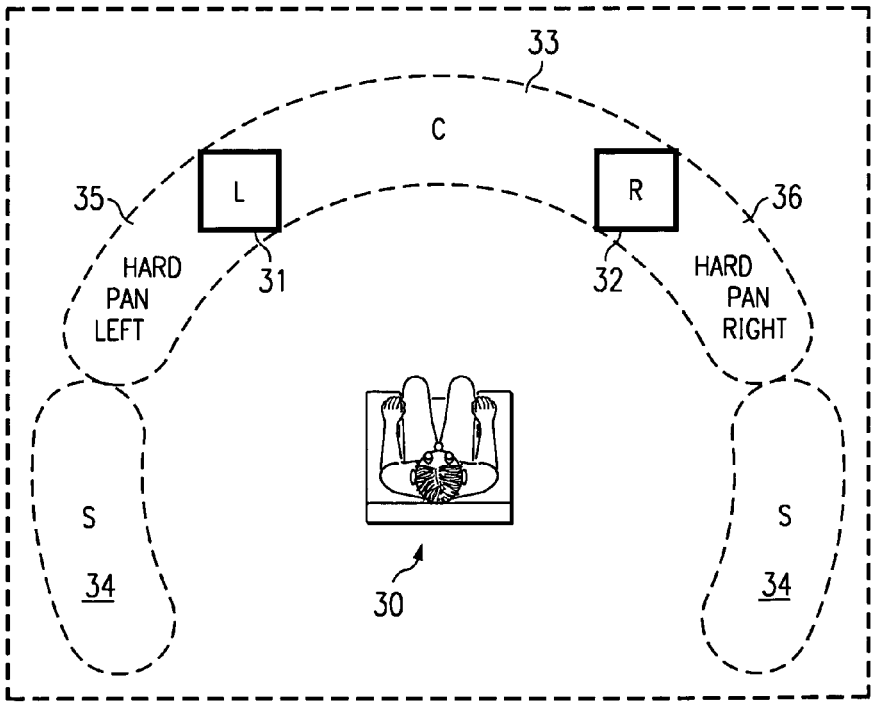
FIG. 2 is an plan view of the sound images produced by the inventive mechanism.

The first sub-system is used to provide a phantom center output. As shown in FIG. 2, the sound image of the phantom center location 33 appears to listener 30 to be placed between left 31 and right 32 speakers. Note that the left and right speakers are connected to left output 28 and right output 29 of FIG. 1, respectively. This sub-system may include summers 10, 24, 25, as well as multiplier 14. Both inputs include center information as common information. For example, left input 26 would include center information C as well as left information L, and right input 27 would include center information C as well as right information R. Summer 10 combines left input 26 and right input 27 in phase. Thus, the output of summer 10 is L+R+2C. For the sake of simplicity assuming that stereo information is not present, i.e. only center information is present, then the output of summer 10 would be 2C, which is a mono signal. This output from summer 10 may be modified by multiplier 14, and recombined with the left and right input signals in summers 24 and 25, respectively. Multiplier 14 may have a control input (not shown) which is used to set the amount of attenuation or amplification that the multiplier applies to its input signal. The control input may be preset during manufacturing, or may be variably set by a processor or listener. Note that attenuator 13 and delay device 12 have similar control inputs which may be used to set the attenuation in attenuator 13 and the delay in delay device 12. Although in the preferred embodiment, an attenuator 13 is used, a multiplier may be used in place of attenuator 13 without departing from the scope of the present invention. Multiplier 14 could be used to reduce or increase the output from summer 10, to turn down or increase the effect of the phantom center channel. It has been empirically shown that the phantom center sub-system is desirable so as to improve the imaging of the phantom center. Thus, in the preferred embodiment, the center information is passed to left output 28 and right output 29 after being added in summers 24 and 25 to the outputs of the second and third sub-systems from summers 22, 23, and summers 20, 21 respectively. The high degree of expansion of the stereo information and the surround information due to processing through Q-filters 16, 15, 17 may tend to dominate the center information. Thus, the center subsystem compensates for Q-filters 16, 15, 17.

The second sub-system is used to provide a virtual surround channel. As shown in FIG. 2, the sound images of the surround channel location 34 appear to the listener 30 to be placed at the left and right sides of the listener 30. The second sub-system includes summers 11, 18, 19, 22, 23, delay device 12, attenuator 13, as well as Q-filters 15 and 17. Q-filters 15, 16 and 17 could be Q1 filters, which is described in U.S. Pat. Nos. 5,105,462 and 5,208,860 both to Lowe et al., wherein each of these patents are hereby incorporated by reference. Surround information would be included as common information to both inputs 26, 27. However, the Dolby encoder encodes such information in the two inputs with opposite phases. For example, left input 26 could include surround information S as well as left information L, and right input 27 could include phase inverted surround information −S as well as right information R. Summer 11 combines the left input and right inputs in opposite phase. For example, one of the input signals, say the right input (R−S) 27 may be phase inverted by summer 11 and combined with the other input signal, say the left input (L+S) 26 to produce L+S−(R−S) or (L−R+2S). Thus, the output of summer 11 is (L−R+2S). Although summer 11 includes an inverter, the invertor could be located separately from the summer. Similarly, summers 18, 19 and 21 shown to have invertors, could have the invertors located separately. The inverter multiplies a signal by −1, and therefore the polarity of the amplitude is changed. Any positive amplitude becomes negative and any negative amplitude becomes positive. For the sake of simplicity assume that stereo information is not present, i.e. only mono-surround information is present, then the output from summer 11 would be 2S, which is a mono signal.

The output from summer 11 is then input to delay device 12 and attenuator 13. In the preferred embodiment, the delay effectuated by delay device 12 is typically 0.5 ms while the attenuation effectuated by attenuator 13 is typically 3 dB. Although the delay and attenuation have been described as being 0.5 ms and 3 dB respectively, a range of values for both delay and attenuation may be used without departing from the scope of the present invention. Thus, in alternative embodiments, the attenuation may be in the range 2 dB to 6 dB and the delay may be in the range 167 $\mu$s to 667 $\mu$s. Attenuation is desirable to prevent the apparent location of the image of the sound from being shifted to one side because of the delay in the other signal. Thus, two separate signals are created from the same signal because of delay device 12 and attenuator 13 with one of the signals being delayed and the other being attenuated. The delay and attenuation create a stereo-like effect from a monaural input.

The delayed signal is then passed through Q-filter 15 which contributes to the expansion of the sound image. The signal from delay device 12 is also fed to summer 18. The output from Q-filter 15 is phase inverted by summer 19 and added to the signal passing through attenuator 13. Similarly, the attenuated signal is passed through Q-filter 17, which contributes to the expansion of the sound image. The signal from attenuator 13 is also fed to summer 19. The output from Q-filter 17 is phase inverted and added to the signal passing through delay device 12 by summer 18. Thus, virtualization of the surround sound may be achieved in this manner to provide a highly expanded stereo surround signal from a mono or stereo signal. In the preferred embodiment, the expanded surround information is then added in summers 22 and 23 to the output of summers 20, 21, respectively. The outputs of summers 22 and 23 form one of the inputs to summers 24 and 25, respectively. The output from summers 24 and 25 go to left output 28 and right output 29.

Note that the surround sub-system removes the center channel information. Since the center channel information is encoded in-phase in the left and right inputs, summer 11 with the inverted input will cancel the center information during the L−R combination. Similarly, the phantom center sub-system removes the surround information. Since the surround information is encoded in opposite phase in the left and right inputs, summer 10 will cancel the surround information during the L+R combination.

The third sub-system is used to provide an expanded stereo sound image. As shown in FIG. 2, sound images 35 and 36 of the expanded stereo channels appear to listener 30 to be located outside of the left and right speakers 31 and 32. In the preferred embodiment, this sub-system includes multiplier 54, Q-filter 16, and summers 20 and 21. Multiplier 54, Q-filter 16 and summers 20, 21 comprise a single filter QXpander circuit, although a double filter QXpander circuit may also be used, wherein QXpander is a registered trademark of QSound. A single filter and a two filter QXpander circuit is described in co-pending and commonly assigned U.S. application Ser. No. 08/858,586, which is hereby incorporated herein by reference. A two filter QXpander circuit is described in U.S. Pat. No. 5,440,638 to Lowe et al., which is hereby incorporated herein by reference. The Q-filter 16 may be a Q1 filter.

Since the input to the expansion sub-system is the output from summer 11, the signal delivered to Q-filter 16 would not have any center information but could contain surround information, i.e. the signal delivered to Q-filter 16 is L−R+2S. Assume, that the signal from summer 11 does not contain any surround information, then the output of summer 11 is L−R which is inputted into Q-filter 16, which adjusts the amplitude and phase of the signal on a frequency dependent basis. Note that multiplier 54 can modify the signal prior to input to Q-filter 16 by either boosting or attenuating the signal. The Q-filtered signal is recombined with the left and right input signals by summers 20 and 21, respectively. Note that the filtered signal from Q-filter 16 is inverted by summer 21 and combined with the right input signal. The inversion at summer 21 ensures that the signal from the left input has been inverted as part of the Q-processing. The sound image created by this Q-filtering is shown in FIG. 2, where the images 35, 36 have been hard panned to the left and right of the left and right speakers, respectively. In an alternative embodiment, the signal from left input 26 may be inverted at summer 11 instead of the signal from right input 27 being inverted at summer 11. In such an embodiment, the signal from Q-filter 16 into summer 20 is inverted instead of the signal fed into summer 21.

Note that the mono center information is not processed by Q-filter 16, and that only the difference information (L−R) from summer 11 is processed by Q-filter 16. By virtue of its operation the information processed by Q-filter 16 and then summed back with the left and right signals at summers 20 and 21 respectively, create an expanded stereo effect. The surround information is not virtualized by this portion of the circuit. Note that the output from Q-filter 16 is inverted by summer 21 and combined with the right input signal, while the output from Q-filter 16 is combined in-phase with the left signal. These signals are then combined with the outputs from summers 18 and 19, the surround channel virtualization portion of the circuit, in summers 22 and 23, and the output from multiplier 14, the center channel portion of the circuit, in summers 24 and 25.

Furthermore, the monophonic, center channel information is not present in any of the Q-filters 15, 16, and 17. Matrix surround encoding allows the sound signals to be steered to four separate channels—left, right, center, and surround. However, it is often desirable to simultaneously steer to either the left and right channels or the center and surround channels. Thus, a matrix encoded stereo input signal may be in the left and right channel mode or the center and surround channel mode at any given time. If the input signal is in the center/surround mode, then Q-filters 15 and 17 may be used to synthesize two channels which are then processed so as to create two virtual surround channels upon playback. This process is known as Omni-to-3D and discussed in greater detail in copending U.S. patent application Ser. No. 08/858,594, which is hereby incorporated herein by reference. The delay device 12 and attenuator 13 create a synthetic stereo difference from the monophonic surround channel information received from the summer 11. In the preferred embodiment, acoustic images 34 of two widely placed surround speakers is produced by dividing the difference signal from summer 11 into two channels, passing them through two filters 15, 17, inverting the filtered signals and combining them with the other synthesized stereo channel. If the input signal is in the left/right mode, then QXpander circuit comprising of summer 11, Q-filter 16 and summers 20, 21 produces an expanded stereo effect.

However, there is no active steering between the left/right mode and the center/surround mode, i.e. the signal continually passes through all the Q-filters 15, 16, 17. Thus, both the stereo expansion and Omni-to-3D are processed continually. The inventive mechanism 100 allows the dominance of one enhancement over the other by achieving a relative balance between the two subsystems. This relative balance may be achieved empirically. The relative balance between stereo expansion and omni-to-3D produces enhancements in the sound coming from the speakers which could not be achieved by the individual subsystems.

Although summers 20, 22, and 24 have been shown as separate summers for clarity, they could be combined and a single summer used instead to provide the desired effect. Similarly, although summer 21 includes a phase inverter, in an alternative embodiment a separate phase inverter could be used to invert the signal from Q-Filter 16 into summer 21, and summers 21, 23, 25 could be combined to provide the desired output signal.

Figure 3:
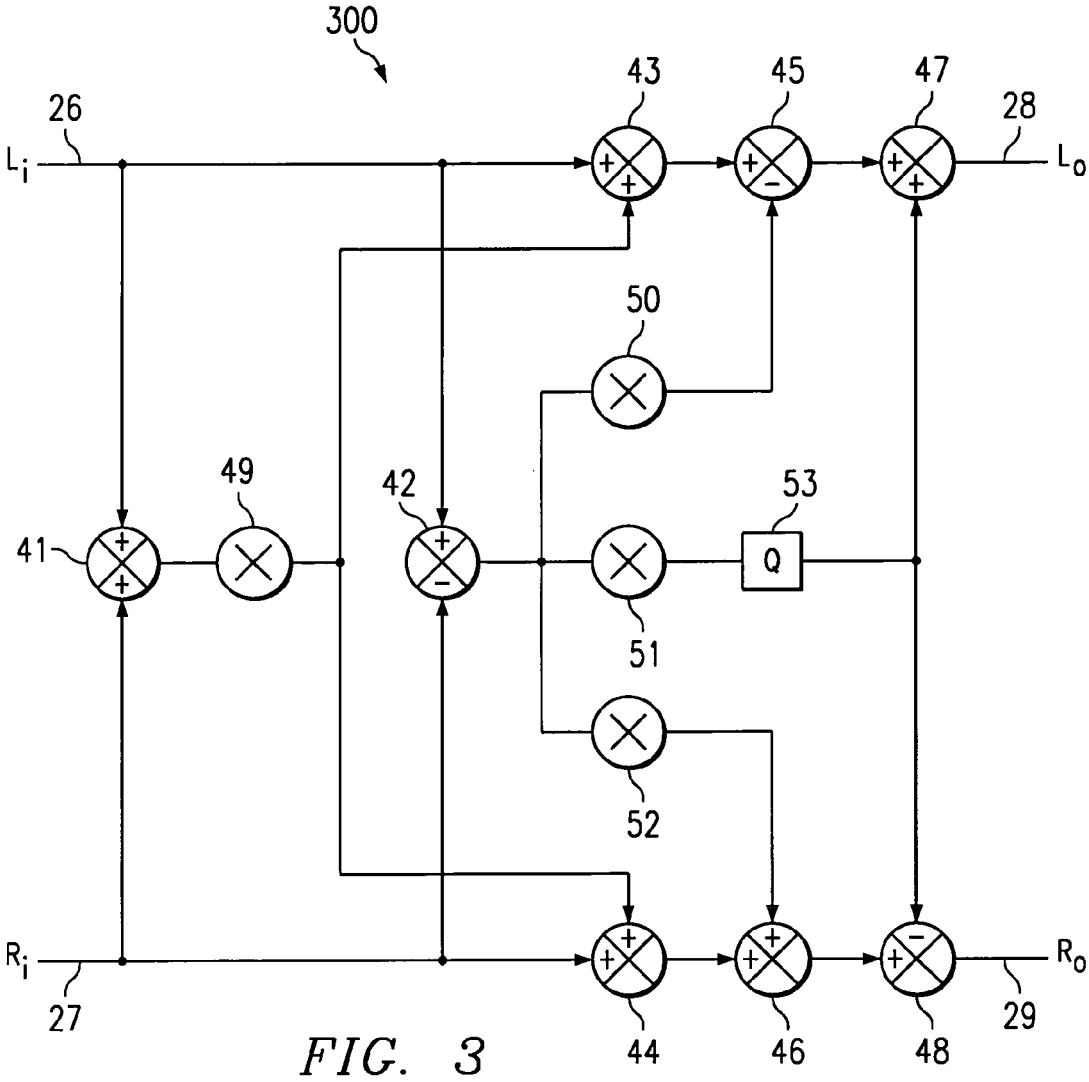
FIG. 3 is a schematic representation of an alternative embodiment of the inventive mechanism.

FIG. 3 depicts an alternative embodiment 300 of the inventive mechanism of the present invention. In this embodiment the first sub-system includes summers 41, 43 and 44, as well as multiplier 49. Center information would be included as common information to both inputs. For example, left input 26 would include center information C as well as left information L, and right input 27 would include center information C as well as right information R. Summer 41 combines the left input 26 and right input 27 in phase. Thus, the output of summer 41 is L+R+2C. For the sake of simplicity assume that stereo information is not present, i.e. only center information is present, then the output would be 2C, which is a mono signal. This output from summer 41 is then modified by multiplier 49, and recombined with the left and right input signals by summers 43 and 44, respectively. Multiplier 49 has a control input (not shown) which is used to set the amount of amplification or attenuation that the multiplier applies to its input signal. In the embodiment shown in FIG. 3, the value of multiplier 49 is set to 0.55. However, a range of values may be used depending on the particular implementation. Thus, in alternative embodiments, the value of multiplier 49 may be varied within a 15% range of the above value. The control input may be preset during manufacturing, or may be variably set by a processor or listener. Note that each of the multipliers 50, 51 and 52 would have similar control inputs. In the embodiment shown in FIG. 3, the value of multiplier 50 is set to 0.75. However, a range of values may be used depending upon the particular implementation. Thus, in alternative embodiments, the value of multiplier 50 may be varied within a 15% range of the above values. Similarly, in the embodiment shown in FIG. 3, the value of multiplier 52 is set to 0.75. However, a range of values may be used depending upon the particular implementation. Thus, in alternative embodiments, the value of multiplier 52 may be varied within a 15% range of the above values. In the embodiment shown in FIG. 3, the value of multiplier 51 is set to 0.80. However, a range of values may be used depending upon the particular implementation. Thus, in alternative embodiments, the value of multiplier 51 may be varied from 0.24 to 1.20 without departing from the scope of the present invention. In theory, the value of multiplier 51 may be allowed to approach infinity.

Multiplier 49 would be used to reduce the output of summer 41, to turn down the effect of the phantom center channel. Note that center information would be passed to left output 28 through summers 43, 45 and 47 and right output 29 through summers 44, 46, and 48. However, it has been empirically shown that the phantom center sub-system is desirable so as to improve the imaging of the phantom center. The high degree of expansion of the stereo information from the application of Q-filter 53 tends to dominate the center information. Thus, the center subsystem compensates for the Q-filter 53.

The second sub-system of the alternative embodiment includes summers 42, 45 and 46, as well as multipliers 50 and 52. Surround information would be included as common information to both inputs 26, 27. However, the Dolby encoder encodes such information in the two inputs with opposite phases. For example, left input 26 would include surround information S as well as left information L, and right input 27 would include surround information −S as well as right information R. Summer 42 combines the left input 26 and right input 27 in opposite phase. Thus, the output of summer 42 is (L+S)−(R−S) or (L−R+2S). Although summer 42 includes an inverter, the inverter could be located separately from the summer. Similarly, summers 45 and 48 also shown to have invertors, could have the invertors located separately. For the sake of simplicity assume that stereo information is not present, i.e. only surround information is present, then the output would be 2S, which is a mono signal. This output is then modified by multipliers 50 and 52, and recombined with the left and right input signals by summers 45 and 46, respectively. Surround image placement 34 shown in FIG. 2 is enhanced from the opposite phase of signals from summers 45 and 46, i.e. note that the output of summer 42 is recombined with each input signal such that the surround signal from summer 42 is phase flipped with respect to the phase of the surround signal present in the input signals. In other words, summer 45 combines the left input signal (L+S) with the phase flipped output of summer 42 (−2S) to yield −S, if multiplier 50 is set to 1. If multiplier 50 is set to a value greater than 1, i.e. for boosting the signal, then the output of summer 45 will be less than −S, e.g. −2S.

Note that the surround sub-system removes the center channel information. Since the center channel information is encoded in phase in the left and right inputs, the summer 42 with the inverted input will cancel the center information during the L−R combination. Similarly, the phantom center sub-system removes the surround information. Since the surround information is encoded in opposite phase in the left and right inputs, the summer 41 will cancel the surround information during the L+R combination.

The third sub-system of the alternative embodiment includes Q-filter 53, summers 47 and 48, and multiplier 51. Since the input to the expansion sub-system is the output from summer 42, then the signal delivered to Q-filter 53 would not have any center information, but could contain surround information, i.e. L−R+2S. The Q-filter 53 could be a Q1 filter. Assume, that the signal from summer 42 does not contain any surround information, thus the output of summer 42 is (L−R) which is inputted into Q-filter 53, which adjusts the amplitude and phase of the signal on a frequency dependent basis. Note that multiplier 51 can modify the signal prior to input to Q-filter 53 by either boosting or attenuating the signal. The Q-filtered signal is recombined with the left and right input signals by summers 47 and 48, respectively. Note that the filtered signal from Q-filter 53 is inverted by summer 48 and combined with the output of summer 46. The inversion at summer 46 ensures that the signal from the left input has been inverted as part of the Q-processing. The sound image created by Q-filtering is shown in FIG. 2, where the images 35, 36 have been hard panned to the left and right of the left and right speakers, respectively. In an alternative embodiment, the signal from left input 26 may be inverted at summer 42 instead of the signal from right input 27 being inverted at summer 42. In such an embodiment, the signal from Q-filter 53 into summer 47 is inverted instead of the signal fed into summer 48.

Note that the mono center information is not processed by Q-filter 53, and that only the difference information (L–R) from summer 42 is processed by Q-filter 53. By virtue of its operation the information processed by Q-filter 53 and then summed back with the left and right signals at summers 47 and 48 respectively, create an expanded stereo effect. The surround information is not virtualized by this portion of the circuit. Note that the output from Q-filter 53 is inverted by summer 48 and combined with the output from summer 46, while the output from Q-filter 53 is combined in-phase with the output from summer 45. Signals from summers 43 and 44, the center channel portion of the circuit, are combined with the outputs from multipliers 50 and 52, the surround channel virtualization portion of the circuit, in summers 45 and 46. These signals are then combined with the output from Q-filter 53, the expanded stereo portion of the circuit in summers 47 and 48.

Although summer 45 includes a phase inverter, in an alternative embodiment, a separate phase inverter could be used to invert the signal from multiplier 50, and summers 43, 45, 47 could be combined to provide the desired output signal. Similarly, a separate phase inverter could be used to invert the signal from Q-filter 53 into summer 48, and summers 44, 46, 48 could be combined to provide the desired output.

The Q-filters of FIGS. 1 and 3, are IIR or Infinite Impulse Response type filters. These types of filters have a feedback loop, which causes the filter response to last longer. The filters could alternatively be of the FIR or Finite Impulse Response type. The Q-filters can also be implemented as IIR or FIR filters in digital or analog domain. The Q-filters in FIGS. 1 and 3 are preferably multi-stage filters, for example 2-stage filter and 3-stage filter. However, all of the filters could comprise only one stage.

Therefore, the inventive mechanism of FIGS. 1 and 3 operate on center, surround, and stereo information, and process each type of information differently to achieve the proper placement of the different sound images resulting from the different information.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for processing a stereo input signal which includes center information, matrix encoded surround information, and stereo information, the system comprising:

first circuit for providing a center output having center monaural information, which includes a first summer which combines one channel of the stereo input signal with the other channel of the stereo input signal to form a center combined signal which has the surround information removed;

second circuit for providing a surround output from the matrix encoded surround information having surround monaural information, which includes a second summer which combines one channel of the stereo input signal with an inverse of the other channel of the stereo input signal to form a surround combined signal which has the center information removed;

third circuit for providing an expanded stereo output, which includes a first Q-filter which adjusts an amplitude and phase of the surround combined signal on a frequency dependent basis to form a first filtered signal;

a third summer which combines the center combined signal with one channel of the stereo input signal to form a first signal;

a fourth summer which combines the center combined signal with the other channel of the stereo input signal to form a second signal;

a fifth summer which combines an inverse of the surround combined signal with the first signal to form the third signal;

a sixth summer which combines the surround combined signal with the second signal to form a fourth signal;

a seventh summer which combines the first filtered signal with the third signal to form the first output signal; and an eighth summer which combines an inverse of the first filtered signal with the fourth signal to form the second output signal.

2. The system of claim 1 further comprising:

first and second speakers for outputting said first and second output signals.

3. The system of claim 1, further comprising:

a multiplier which modifies the center combined signal.

4. A system for processing a stereo input signal which includes center information, matrix encoded surround information, and stereo information, the system comprising:

means for providing a center output having center monaural information, which includes a first summer which combines one channel of the stereo input signal with the other channel of the stereo input signal to form a center combined signal which has the surround information removed;

means for providing a surround output from the matrix encoded surround information having surround monaural information, which includes a second summer which combines one channel of the stereo input signal with an inverse of the other channel of the stereo input signal to form a surround combined signal which has the center information removed;

means for providing an expanded stereo output, which includes a filter which adjusts an amplitude and phase of the surround combined signal on a frequency dependent basis to form a first filtered signal;

a third summer which combines the center combined signal with one channel of the stereo input signal to form a first signal;

a fourth summer which combines the center combined signal with the other channel of the stereo input signal to form a second signal;

a fifth summer which combines an inverse of the surround combined signal with the first signal to form the third signal;

a sixth summer which combines the surround combined signal with the second signal to form a fourth signal;

a seventh summer which combines the first filtered signal with the third signal to form the first output signal; and an eighth summer which combines an inverse of the first filtered signal with the fourth signal to form the second output signal.

5. The system of claim 4 further comprising:

first and second speakers for outputting said first and second output signals.

6. The system of claim 4, further comprising:

a multiplier which modifies the center combined signal.

7. A method for processing a stereo input signal which includes center information, matrix encoded surround information, and stereo information, the method comprising:

operating a first circuit for providing a center output having center monaural information, which includes a first summer which combines one channel of the stereo input signal with the other channel of the stereo input signal to form a center combined signal which has the surround information removed;

operating a second circuit for providing a surround output from the matrix encoded surround information having surround monaural information, which includes a second summer which combines one channel of the stereo input signal with an inverse of the other channel of the stereo input signal to form a surround combined signal which has the center information removed;

operating a third circuit for providing an expanded stereo output, which includes a filter which adjusts an amplitude and phase of the surround combined signal on a frequency dependent basis to form a first filtered signal;

combining the center combined signal with one channel of the stereo input signal to form a first signal;

combining the center combined signal with the other channel of the stereo input signal to form a second signal;

combining an inverse of the surround combined signal with the first signal to form the third signal;

combining the surround combined signal with the second signal to form a fourth signal;

combining the first filtered signal with the third signal to form the first output signal; and combining an inverse of the first filtered signal with the fourth signal to form the second output signal.

8. The method of claim 7 further comprising:

outputting said first and second output signals using first and second speakers.

9. The method of claim 7, further comprising:

modifying the center combined signal using a multiplier.

* * * * *

UNITED STATES PATENT AND TRADEMARK OFFICE

CERTIFICATE OF CORRECTION

PATENT NO. : 7,003,119 B1 
DATED : February 21, 2006
INVENTOR(S) : John E. Arthur It is certified that error appears in the above-identified patent and that said Letters Patent is hereby corrected as shown below:

Title page,
Item [73], Assignee, "Qsound" should read -- QSound --.
Item [56], References Cited, OTHER PUBLICATIONS,
"PCT Search Report," reference, delete "00" after "IB" and insert -- 99 --.

Signed and Sealed this

Sixteenth Day of May, 2006

JON W. DUDAS
*Director of the United States Patent and Trademark Office*